US007984525B2

(12) United States Patent
Watchorn et al.

(10) Patent No.: US 7,984,525 B2
(45) **Date of Patent: *Jul. 26, 2011**

(54) ACCESS METHOD BETWEEN MARINE STRUCTURES AND APPARATUS

(75) Inventors: Michael John Watchorn, Stocksfield (GB); Timothy William Grinsted, Stocksfield (GB)

(73) Assignee: IHC Engineering Business Limited (GB)

( * ) Notice: Subject to any disclaimer, the term of this patent is extended or adjusted under 35 U.S.C. 154(b) by 670 days.

This patent is subject to a terminal disclaimer.

(21) Appl. No.: 11/659,062

(22) PCT Filed: Aug. 1, 2005

(86) PCT No.: PCT/GB2005/003010

§ 371 (c)(1),
(2), (4) Date: Jan. 31, 2007

(87) PCT Pub. No.: WO2006/013342

PCT Pub. Date: Feb. 9, 2006

(65) Prior Publication Data

US 2008/0301888 A1 Dec. 11, 2008

(30) Foreign Application Priority Data

Aug. 3, 2004 (GB) ..... 0417279.7
Nov. 9, 2004 (WO) ..... PCT/GB2004/004716

(51) Int. Cl.
*E01D 1/00* (2006.01)

(52) U.S. Cl. ..... 14/71.1

(58) Field of Classification Search ..... 14/71.1, 14/69.5, 71.5

See application file for complete search history.

(56) References Cited

U.S. PATENT DOCUMENTS 233,159 A 10/1880 Mooney (Continued)

FOREIGN PATENT DOCUMENTS

CH 241601 3/1946

(Continued)

OTHER PUBLICATIONS

Int'l Search Report for equivalent PCT application No. PCT/GB2005/003010 dated Nov. 22, 2005.

(Continued)

*Primary Examiner* — Thomas B Will
*Assistant Examiner* — Abigail A Risic
(74) *Attorney, Agent, or Firm* — Ryan A. Schneider, Esq.; Troutman Sanders LLP

(57) ABSTRACT

Access means are provided for accessing a fixed offshore structure (70) such as a wind turbine, larger vessel or the like form a smaller vessel (50), or for providing for transfer between vessels. One or more guide wires (12) are connected from the vessel (50) to the fixed structure (70) or second vessel and placed in tension such as by directing the vessel away from the fixed structure. In one embodiment, inflatable members (14) are suspendable from the guide wires and inflation of the inflatable members causes them to extend along the guide wires to form an access surface across which personnel may walk to access the fixed structure or second vessel from the first vessel. Mounting means are also provided which accommodate relative rotational, translational and pitching movement of the apparatus and vessel, caused by wave motion. In another embodiment, a bridge member is retained on a runway of the first vessel and deployed using said guide wires.

37 Claims, 11 Drawing Sheets

U.S. PATENT DOCUMENTS

| | | | | | |
|---|---|---|---|---|---|
| 259,685 | A | | 6/1882 | Haven et al. | |
| 555,542 | A | | 3/1896 | Throop | |
| 1,378,948 | A | | 5/1921 | Hage | |
| 1,759,105 | A | | 5/1930 | Evans | |
| 2,527,653 | A | * | 10/1950 | Pierce | 14/71.1 |
| 2,896,564 | A | | 7/1959 | Wright | |
| 2,955,299 | A | * | 10/1960 | Ingram, Jr. et al. | 114/362 |
| 3,004,391 | A | | 10/1961 | Miller | |
| 3,008,158 | A | | 11/1961 | Stinson | |
| 3,152,568 | A | | 10/1964 | Mayer | |
| 3,216,639 | A | | 11/1965 | Castela | |
| 3,237,414 | A | | 3/1966 | Straub et al. | |
| 3,372,849 | A | | 3/1968 | Hall et al. | |
| 3,503,512 | A | | 3/1970 | Desty et al. | |
| 3,589,580 | A | | 6/1971 | Smulders | |
| 3,608,316 | A | | 9/1971 | Manuel | |
| 3,638,288 | A | | 2/1972 | Pryor | |
| 3,692,144 | A | | 9/1972 | Summer et al. | |
| 3,716,994 | A | | 2/1973 | Pogonowski | |
| 3,739,971 | A | | 6/1973 | Silvestri et al. | |
| 3,747,354 | A | | 7/1973 | Macomber | |
| 3,788,396 | A | | 1/1974 | Shatto, Jr. et al. | |
| 3,808,625 | A | * | 5/1974 | Fowler | 14/71.1 |
| 4,027,486 | A | | 6/1977 | Dougherty | |
| 4,073,155 | A | | 2/1978 | Schiemichen | |
| 4,083,072 | A | | 4/1978 | Ryan | |
| 4,133,067 | A | | 1/1979 | Bennett et al. | |
| 4,133,283 | A | * | 1/1979 | Ryan | 114/230.18 |
| 4,162,551 | A | | 7/1979 | Serrano | |
| 4,169,296 | A | | 10/1979 | Wipkink et al. | |
| 4,222,683 | A | | 9/1980 | Schaloske et al. | |
| 4,285,454 | A | | 8/1981 | Plumettaz | |
| 4,286,346 | A | | 9/1981 | Wiek | |
| 4,333,196 | A | | 6/1982 | Bougaran | |
| 4,363,150 | A | | 12/1982 | Nilsson | |
| 4,366,591 | A | | 1/1983 | Zimmerman | |
| 4,369,538 | A | | 1/1983 | Smedal | |
| 4,406,094 | A | | 9/1983 | Hempel et al. | |
| 4,459,931 | A | | 7/1984 | Glidden | |
| 4,521,132 | A | | 6/1985 | Isakson et al. | |
| 4,581,784 | A | * | 4/1986 | Rousseau et al. | 14/71.1 |
| 4,590,634 | A | | 5/1986 | Williams | |
| 4,596,494 | A | | 6/1986 | Manesse et al. | |
| 4,602,697 | A | | 7/1986 | Aanensen | |
| 4,611,953 | A | | 9/1986 | Owens | |
| 4,655,641 | A | | 4/1987 | Weyler | |
| 4,720,214 | A | | 1/1988 | Brasted et al. | |
| 4,721,412 | A | * | 1/1988 | King et al. | 405/195.1 |
| 4,789,271 | A | | 12/1988 | Sullaway et al. | |
| 4,869,615 | A | | 9/1989 | Galle | |
| 4,872,782 | A | | 10/1989 | Streichenberger | |
| 4,902,169 | A | | 2/1990 | Sutton | |
| 4,917,540 | A | | 4/1990 | Recalde | |
| 5,020,940 | A | | 6/1991 | Smith | |
| 5,126,134 | A | | 6/1992 | Heim et al. | |
| 5,263,624 | A | | 11/1993 | Zuidberg | |
| 5,860,379 | A | | 1/1999 | Moody | |
| 5,893,682 | A | | 4/1999 | Oliveri | |
| 5,950,267 | A | * | 9/1999 | Ricci, Jr. | 14/71.1 |
| 6,131,224 | A | * | 10/2000 | Bernal | 14/69.5 |
| 6,131,528 | A | | 10/2000 | Meek et al. | |
| 6,347,424 | B1 | | 2/2002 | Vatne | |
| 6,408,780 | B1 | | 6/2002 | Ozaki et al. | |
| 6,409,428 | B1 | | 6/2002 | Moog | |
| 6,425,441 | B2 | | 7/2002 | Shaaban et al. | |
| 6,425,708 | B1 | | 7/2002 | Siegfriedsen | |
| 6,435,795 | B1 | | 8/2002 | Brady | |
| 6,439,445 | B1 | | 8/2002 | De Groot et al. | |
| 6,592,416 | B1 | | 7/2003 | Hochschild, III | |
| 6,619,432 | B1 | | 9/2003 | Yasui | |
| 6,651,858 | B2 | | 11/2003 | Shen | |
| 6,739,430 | B2 | | 5/2004 | Hill | |
| 6,745,714 | B1 | | 6/2004 | Faber | |
| 6,923,140 | B1 | | 8/2005 | Cook | |
| 7,021,510 | B2 | | 4/2006 | Ellingson | |
| 7,025,332 | B2 | | 4/2006 | Rincoe | |
| 7,103,935 | B2 | * | 9/2006 | Hill | 14/71.3 |
| 7,178,708 | B2 | | 2/2007 | Grinsted | |
| 7,377,412 | B2 | | 5/2008 | Grinsted | |
| 2001/0040031 | A1 | | 11/2001 | Shaaban et al. | |
| 2002/0083881 | A1 | | 7/2002 | Arias | |
| 2002/0085883 | A1 | | 7/2002 | Meyers et al. | |
| 2003/0182741 | A1 | * | 10/2003 | Prins | 14/71.1 |
| 2003/0217681 | A1 | | 11/2003 | Funk | |
| 2004/0045226 | A1 | | 3/2004 | Dehlsen et al. | |
| 2005/0179019 | A1 | | 8/2005 | Ellingson | |
| 2005/0286979 | A1 | | 12/2005 | Watchorn | |
| 2006/0078385 | A1 | | 4/2006 | Watchorn | |
| 2006/0153644 | A1 | | 7/2006 | Grinsted | |
| 2006/0208245 | A1 | | 9/2006 | Diehl | |
| 2007/0119896 | A1 | | 5/2007 | Grinsted | |
| 2008/0145149 | A1 | | 6/2008 | Grinsted et al. | |
| 2008/0188148 | A1 | * | 8/2008 | Simon-Bouhet | 441/41 |
| 2008/0229524 | A1 | | 9/2008 | Watchorn et al. | |
| 2008/0289126 | A1 | * | 11/2008 | Stapel | 14/71.1 |
| 2009/0028647 | A1 | | 1/2009 | Bingham et al. | |
| 2009/0050045 | A1 | * | 2/2009 | Grimaldi | 114/362 |

FOREIGN PATENT DOCUMENTS

| | | |
|---|---|---|
| CH | 363463 | 7/1962 |
| DE | 597543 | 5/1934 |
| DE | 2341846 | 2/1975 |
| DE | 19607972 | 1/1998 |
| DE | 10249779 | 5/2004 |
| EP | 0255191 | 2/1988 |
| EP | 0296272 | 12/1988 |
| EP | 0524648 | 1/1993 |
| EP | 1101935 | 5/2001 |
| EP | 1209028 | 5/2002 |
| FR | 2465640 | 9/1979 |
| FR | 2586641 | 3/1987 |
| GB | 2033463 | 5/1980 |
| GB | 2086313 | 5/1982 |
| GB | 2156744 | 10/1985 |
| GB | 2158793 | 11/1985 |
| GB | 2175332 | 11/1986 |
| GB | 2175860 | 12/1986 |
| GB | 2225753 | 6/1990 |
| GB | 2246992 | 2/1992 |
| GB | 2390632 | 1/2004 |
| JP | 61211409 | 9/1986 |
| JP | 06002317 | 1/1994 |
| JP | 2005069025 | 3/2005 |
| JP | 2006037397 | 2/2006 |
| NL | 1019706 | 7/2003 |
| NL | 1023142 | 10/2004 |
| RU | 610718 | 6/1978 |
| RU | 757383 | 11/1978 |
| WO | WO 85/01970 | 5/1985 |
| WO | WO 88/03107 | 5/1988 |
| WO | WO 95/14605 | 6/1995 |
| WO | WO/97/29946 | 8/1997 |
| WO | WO 02/20343 | 3/2002 |
| WO | WO 02/48547 | 6/2002 |
| WO | WO 03/066426 | 8/2003 |
| WO | WO 03/066427 | 8/2003 |
| WO | WO 2004/038108 | 5/2004 |
| WO | WO 2004/040182 | 5/2004 |
| WO | 2004070119 | 8/2004 |
| WO | WO 2004/083529 | 9/2004 |
| WO | WO 2006/076920 | 7/2006 |
| WO | WO 2006/087540 | 8/2006 |
| WO | WO 2007/015079 | 2/2007 |
| WO | WO 2007/091042 | 8/2007 |

OTHER PUBLICATIONS

Int'l Search Report for equivalent PCT application No. PCT/GB2004/004716 dated Feb. 23, 2005.

Search Report for equivalent British application No. GB 403362 7 dated Jun. 29, 2004.

Great Britain Search Report dated Apr. 12, 2005 for International Application No. GB0503083.8.

Great Britain Search Report dated Apr. 26, 2006 for British Application No. GB0602503.5.

Great Britain Search Report for Application No. GB 0224656.9 Dated Nov. 22, 2002.

Great Britain Search Report for Application No. GB 0225496.9 Dated Apr. 28, 2003.
International Search Report for PCT Application No. PCT/GB03/04529 Dated Feb. 11, 2004.
International Search Report for PCT Application No. PCT/GB03/04697 Dated Apr. 22, 2004.
International Search Report for PCT Application No. PCT/GB04/01208 Dated Jul. 19, 2004.
International Search Report and Written Opinion for PCT Application No. PCT/GB06/00525 Dated May 19, 2006.
International Search Report for PCT Application No. PCT/GB06/02860 Dated Oct. 26, 2006.
International Search Report and Written Opinion for PCT Application No. PCT/GB07/00400 Dated Jun. 11, 2007.

* cited by examiner

ACCESS METHOD BETWEEN MARINE STRUCTURES AND APPARATUS

BENEFIT CLAIMS

This application is a US National Stage of International Application No. PCT/GB2005/003010, filed 1 Aug. 2005, which claims the benefit of both GB 0417279.7, filed 3 Aug. 2004, and International Application No. PCT/GB2004/004716, filed 9 Nov. 2004.

The present invention relates to method and apparatus for providing access between marine structures, and more especially for providing access from a vessel, such as a relatively small vessel, to a relatively larger vessel or to a fixed offshore structure, or between two vessels of comparable size, especially larger vessels. In the case of transfer between vessels, the invention is particularly advantageous when the vessels are in open water and/or under way. Said access may be, or may include, the transfer of personnel and/or the transfer of goods and equipment.

When at sea, or on similar large body of water such as larger lakes, it is often necessary for personnel or equipment to transfer from one "marine structure" to another. In the context of this application, the term "marine structure" refers to: each of two vessels of preferably of broadly similar size between which transfer is effected; or to each of a relatively small boat employed to carry personnel and equipment to a worksite and the worksite itself. The worksite might be a larger vessel, such as when a pilot needs to board the larger vessel from a pilot boat, or a fixed offshore structure such as an oil or gas rig, wind turbine or the like where maintenance workers need access from time to time. Most preferably one of the marine structures between which transfer is effected is a vessel navigable under its own power. In the context of transfer from a relatively small vessel such as an RIB, and given that the motion of a larger vessel is usually much less relative to the motion of a smaller vessel, the term "fixed structure" will be used hereinafter to refer to both fixed offshore structures and relatively larger vessels. "RIB" refers to a "rigid inflatable boat" also known as "RHIB" or "rigid hull inflatable boat".

Conventionally, a worker is required to step from the transfer (or other) vessel onto a flexible or rigid ladder or onto a rigid gangway at the side of the fixed structure (off shore structure or second vessel). This is inherently hazardous, particularly for those who are not accustomed to working in a marine environment. In all but the calmest of seas, relative motion between the vessel and the fixed structure, or between the respective vessels, is substantial. Stepping from a moving vessel onto a stationary ladder is difficult and it is easy to slip and, potentially, to fall into the water. This carries the danger of being crushed between the vessel and the fixed structure or between the respective vessels. Because of the motion of waves and the effect of currents it is, in any case, difficult to keep a vessel on station, i.e. in the correct position with respect to the fixed structure or second vessel, and there is also the danger of collision between the vessel and the fixed structure or between the two vessels.

For these reasons, safety regulations limit the transfer of personnel from a vessel to a fixed structure to times when the sea conditions are within certain parameters, typically to circumstances where the wave height is less than about 0.7 m to 1 m. The consequence of this is that many working days are lost when wave conditions are such that access to the fixed structure is not possible. This can represent a major expense for those involved in the construction and maintenance of offshore facilities.

The present invention seeks to alleviate these problems by providing a method and apparatus which allow safe access from a vessel to a fixed structure (an offshore structure or a larger vessel), or between vessels typically of generally similar size, in particular between larger vessels, especially in a greater range of sea conditions.

According to a first aspect of the invention there is provided a method of providing access between first and second marine structures comprising:

- providing the first marine structure with a runway
- providing a gangway apparatus mounted in a stored condition on the runway;
- positioning the first and second marine structures proximate one another;
- providing at least one guide wire, the gangway apparatus being attached or attachable to a said guide wire by means of one or more slidable fixings;
- connecting the at least one guide wire between a location on the first marine structure and an attachment location on the second marine structure proximate the location of entry to the second marine structure;
- controlling and, where necessary, adjusting the position of one or both of the first and second marine structures so that they are maintained in spaced apart relation to one another, and maintaining the at least one guide wire at a desired tension;
- moving the gangway apparatus from the stored condition to a use condition by moving the gangway apparatus along the runway and sliding the slidable fixing(s) along a said guide wire and, where necessary, adjusting the position of the first marine structure until the gangway apparatus spans the gap between the first marine structure and location of entry to the second marine structure.

Preferably the step of positioning the first and second marine structures proximate one another comprises positioning the first marine structure with respect to the second marine structure.

Preferably the step of controlling and, where necessary, adjusting the position of one or both of the first and second marine structures so that they are maintained in spaced apart relation to one another comprises controlling and where necessary adjusting the position of the first marine structure with respect to the second marine structure.

Preferably the runway is inclined with respect to the horizontal such that the gangway apparatus moves downwardly when moving from the stored condition to the use condition.

Preferably at least one end portion of the gangway apparatus remains connected to the runway when the gangway apparatus is in its use condition.

In one preferred embodiment of the invention the first marine structure is a vessel and the second marine structure is a fixed structure.

In another preferred embodiment of the invention the first and second marine structures are vessels.

Where both the first and second marine structures are movable vessels, the step or steps of adjusting the position of the marine structures may, if desired, comprise the step of adjusting the position of the first marine structure, adjusting the position of the second marine structure or adjusting the positions of the first and second marine structures.

In a particularly preferred form of the invention the gangway apparatus comprises at least one inflatable member attached to a said guide wire by said slidable fixings and transformable by inflation thereof from a compact state to an extended state, the method further comprising inflating the inflatable member with an inflating fluid before said gangway apparatus is moved along said runway.

In an alternative form of the invention the gangway apparatus comprises at least one inflatable member attached to a said guide wire by said slidable fixings and transformable by inflation thereof from a compact state to an extended state, the method further comprising inflating the inflatable member with an inflating fluid after said gangway apparatus is moved along said runway.

Most preferably, the gangway apparatus slides along the runway contemporaneously with the step of sliding the gangway apparatus along the guide wire(s).

One embodiment of this aspect of the invention comprises providing a gangway apparatus comprising a single inflatable member.

Another preferred embodiment of this aspect of the invention comprises providing a gangway apparatus including a plurality of inflatable members.

Preferably in this embodiment the inflatable member comprises an outer skin enclosing a plurality of inflatable tubes.

According to a second aspect of the invention there is provided and apparatus for providing a bridge structure for the transfer of personnel, goods or equipment from a first marine structure to a second marine structure, the apparatus comprising:

- a gangway apparatus operatively moveable from a stored condition to a use condition;
- a runway operatively mounted on the first marine structure and on which the gangway apparatus is mounted in its stored condition;
- at least one guide wire and means for attaching the guide wire to the first marine structure and to an attachment location on the second marine structure proximate the location of entry to the second marine structure;
- means mounted in use on the first or second marine structure for maintaining a desired tension in the at least one guide wire;
- one or more linkages attached to said gangway apparatus by means of which the gangway apparatus is moveable along the runway from the stored condition to, or towards, the use condition;
- one or more slidable fixings attached to the gangway apparatus and slidable along a said guide wire on deployment of the gangway apparatus, by means of which fixings the gangway apparatus is operatively supportable by the at least one guide wire to span the gap between the first and second marine structures.

Preferably the runway is inclined to horizontal. Most preferably the means for maintaining a desired tension in the at least one guide wire is mounted in use on the first marine structure.

In preferred forms of this aspect of the invention, the runway comprises at least one rigid rail.

Most preferably, the runway comprises a pair of substantially parallel rails.

Preferably the or each rail is rectilinear.

Most preferably, the linkage comprises a skate, truck, bogie, carriage or the like disposed between the gangway apparatus and the or each rail and adapted to slide, roll or otherwise move along each rail.

In an alternative form of this aspect of the invention, the runway comprises one or more tensioned cables.

Preferably, the runway is mounted in use to extend from a highest point towards a central region of the vessel to a lowest point near the stern or side of the vessel.

It is particularly preferred that at least an end portion of the gangway apparatus remains attached to the runway in the use condition.

In particularly preferred forms of this aspect of the invention, the gangway apparatus comprises at least one inflatable member.

It is especially preferred that the gangway apparatus comprises a plurality of inflatable members which are independently inflatable and more especially that the gangway apparatus comprises an outer skin enclosing a plurality of inflatable tubes.

In preferred forms of this aspect of the invention at least one inflatable portion of the gangway apparatus, in its expanded state, has an upper surface which operatively forms a walkway for personnel using the bridge structure.

In one form of this aspect of the invention the apparatus comprises means for joining two or more inflatable members together to form said walkway. Preferably said two or more inflatable members are joined in side-by-side relation.

In one form the apparatus further comprises inflatable members defining in their expanded state side walls of the bridge. Means are preferably provided for joining two or more inflatable members together to form said side walls. Preferably said two or more inflatable members are joined in side-by-side relation.

Preferably an upper surface of an inflatable portion of said gangway apparatus includes a non-slip surface.

Preferably the apparatus of this aspect of the invention further comprises a plurality of upright posts attached at intervals to said gangway apparatus and safety ropes or nets attached to said posts.

Preferably the apparatus of this aspect of the invention also comprises at least one safety rope extending lengthwise of the apparatus to which a user's safety harness is operatively attachable.

In one form of this aspect of the invention, the at least one inflatable member is, in its expanded state, operatively suspended below a single guide wire.

In another, preferred, form of this aspect of the invention the at least one inflatable member is, in its expanded state, operatively mounted above a single guide wire.

In an alternative variation, the at least one inflatable member is, in its expanded state, operatively mounted on a pair of substantially parallel guide wires.

In one preferred embodiment of the invention the first marine structure is a vessel and the second marine structure is a fixed structure.

In another preferred embodiment of the invention the first and second marine structures are first and second vessels respectively.

A third aspect of the invention provides apparatus for carrying out the method of the first aspect of the invention.

A fourth aspect of the invention provides a vessel having mounted thereon apparatus as defined in the second or third aspect of the invention.

Conveniently, the vessel comprises an inflatable boat, in particular an RIB.

A fifth aspect of the invention provides a mounting structure for mounting an apparatus as defined in second aspect of the invention on a vessel, comprising at least one of:

- i) means for accommodating rotational movement of the vessel with respect to the apparatus;
- ii) means for accommodating translational movement of the vessel with respect to the apparatus; and
- iii) means for accommodating pitching movement of the vessel with respect to the apparatus.

A sixth aspect of the invention provides a mounting structure for mounting an apparatus as defined in the second aspect of the invention on a vessel, comprising:

a first mounting component mounted in rotationally fixed relation to the vessel a second mounting component mounted on the first mounting component and attached in rotationally fixed relation to the apparatus, the first and second mounting components being rotatable with respect to one another.

Preferably the first and second components define a slew ring bearing.

Preferably the mounting structure further comprises a first frame element disposed between the second component and the apparatus and mounted with translational freedom of movement with respect to the second mounting component.

Preferably the mounting structure further comprises biasing means adapted to bias the first frame element towards a desired location in its translational motion.

Preferably the mounting structure further comprises a second frame element pivotally mounted with respect to the second mounting component operatively attached to the apparatus, wherein the second frame element operatively pivots about a nominally horizontal axis substantially perpendicular to the longitudinal axis of the at least one inflatable member when extended.

Preferably the second frame element is pivotally mounted on the first frame element.

A seventh aspect of the invention comprises a transfer system comprising a mounting structure as defined in the sixth aspect of the invention and an apparatus, as defined in the second aspect of the invention, attached thereto.

An eighth aspect of the invention comprises a vessel having mounted thereon a mounting structure as defined in the sixth aspect to the invention.

The present invention also relates to a vessel having mounted thereon a transfer system as defined above. Conveniently, the vessel comprises an inflatable boat, in particular an RIB.

For a better understanding of the invention and to show how the same may be carried into effect, reference will be made, by way of example only, to the following drawings, in which.

Figure 5A:
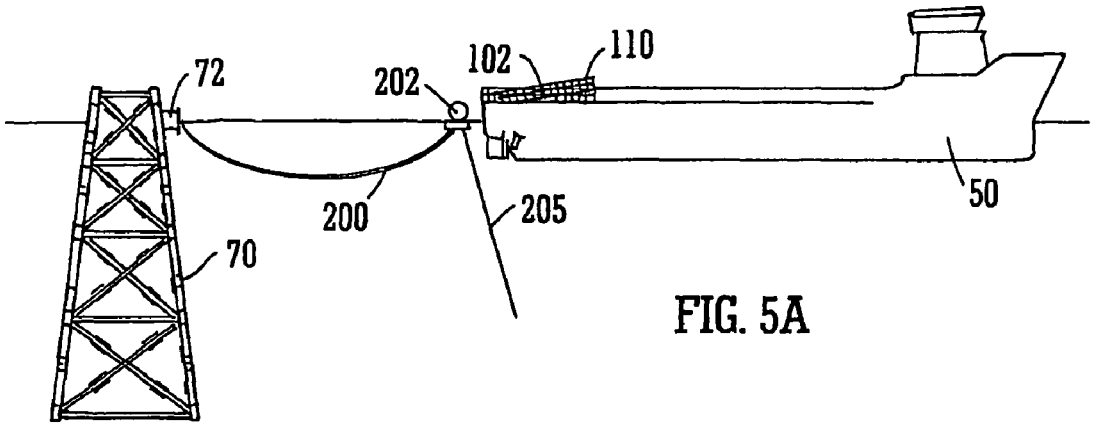
FIGS. 5 to 9 show a preferred sequence for attachment of the apparatus of the invention to a fixed offshore structure, and in particular.
Figure 5B:
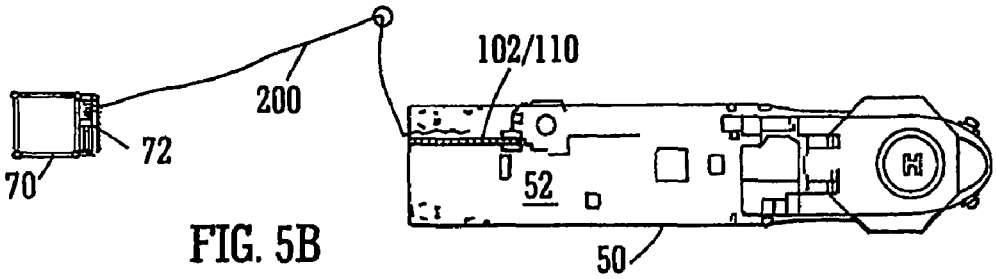
Figure 6A:
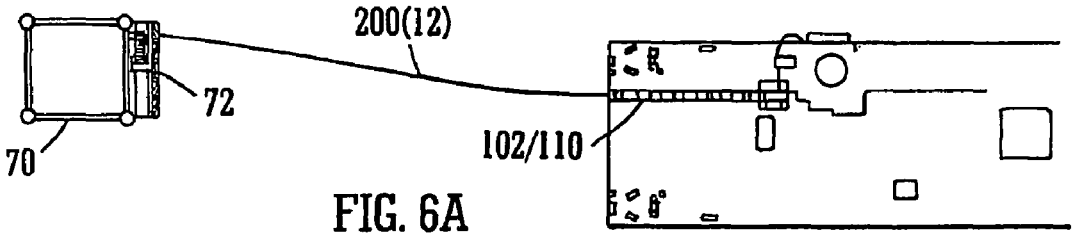
Figure 6B:
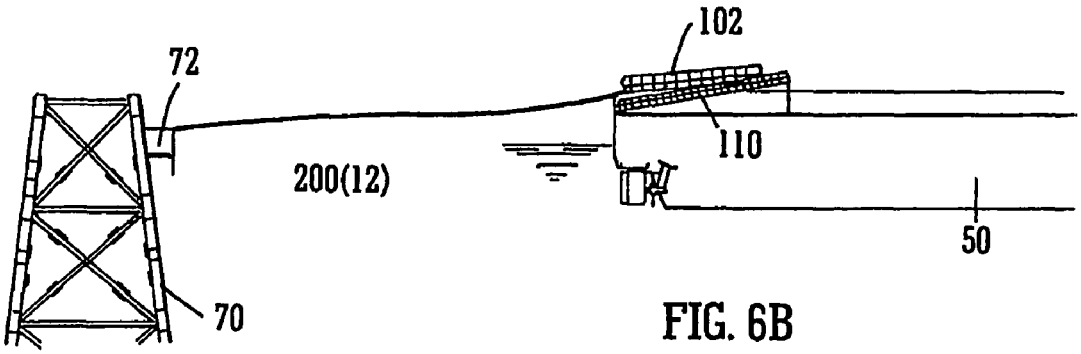
Figure 7A:
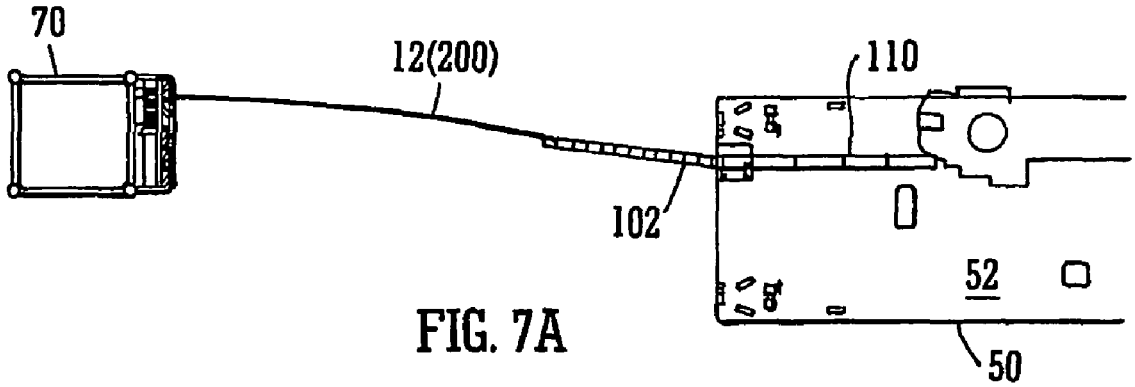
Figure 7B:
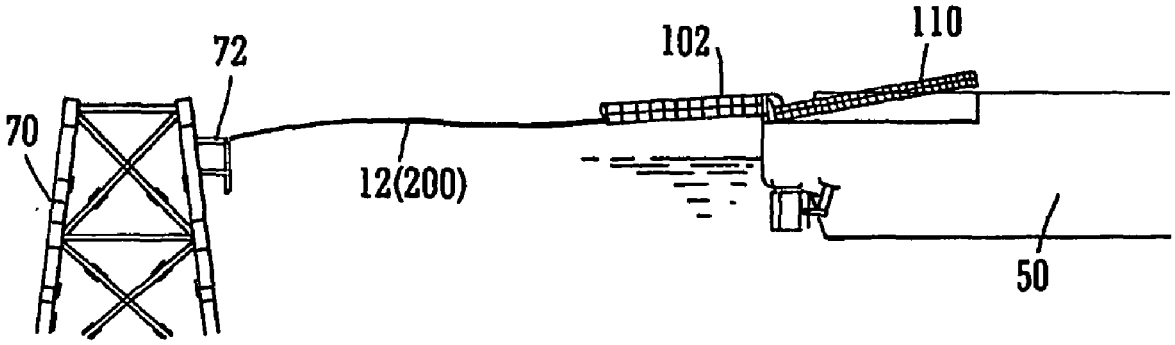
Figure 8A:
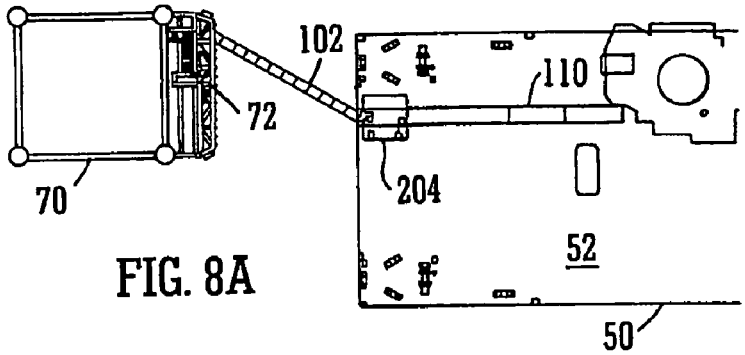
Figure 8B:
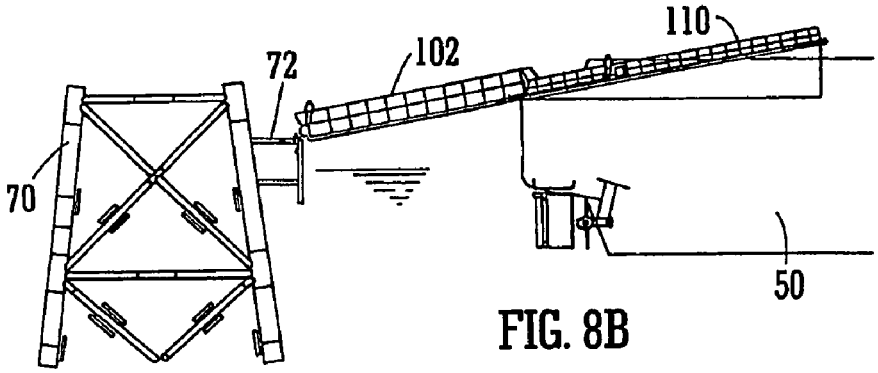
Figure 9A:
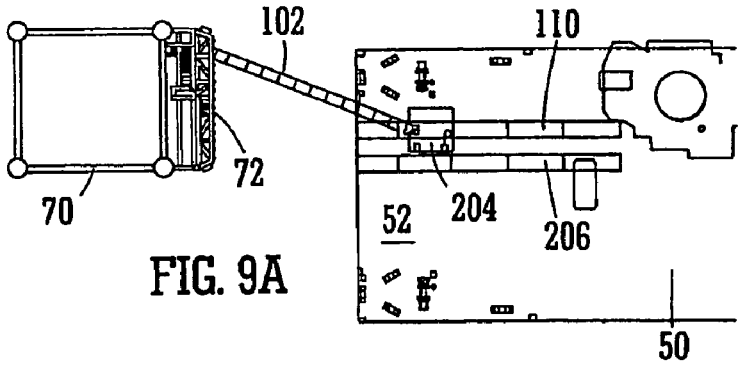
Figure 9B:
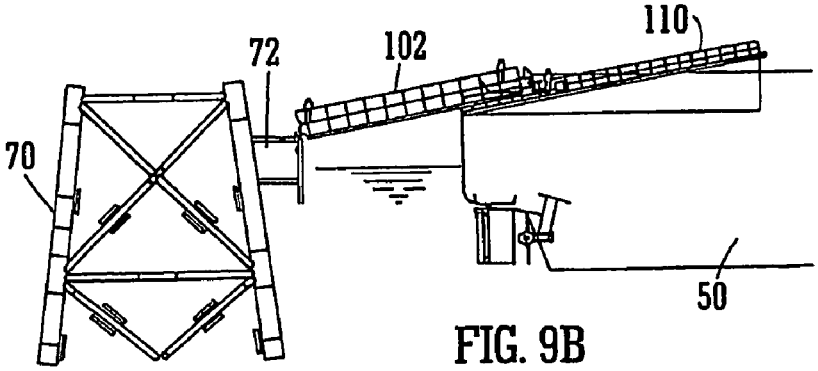
Figure 10:
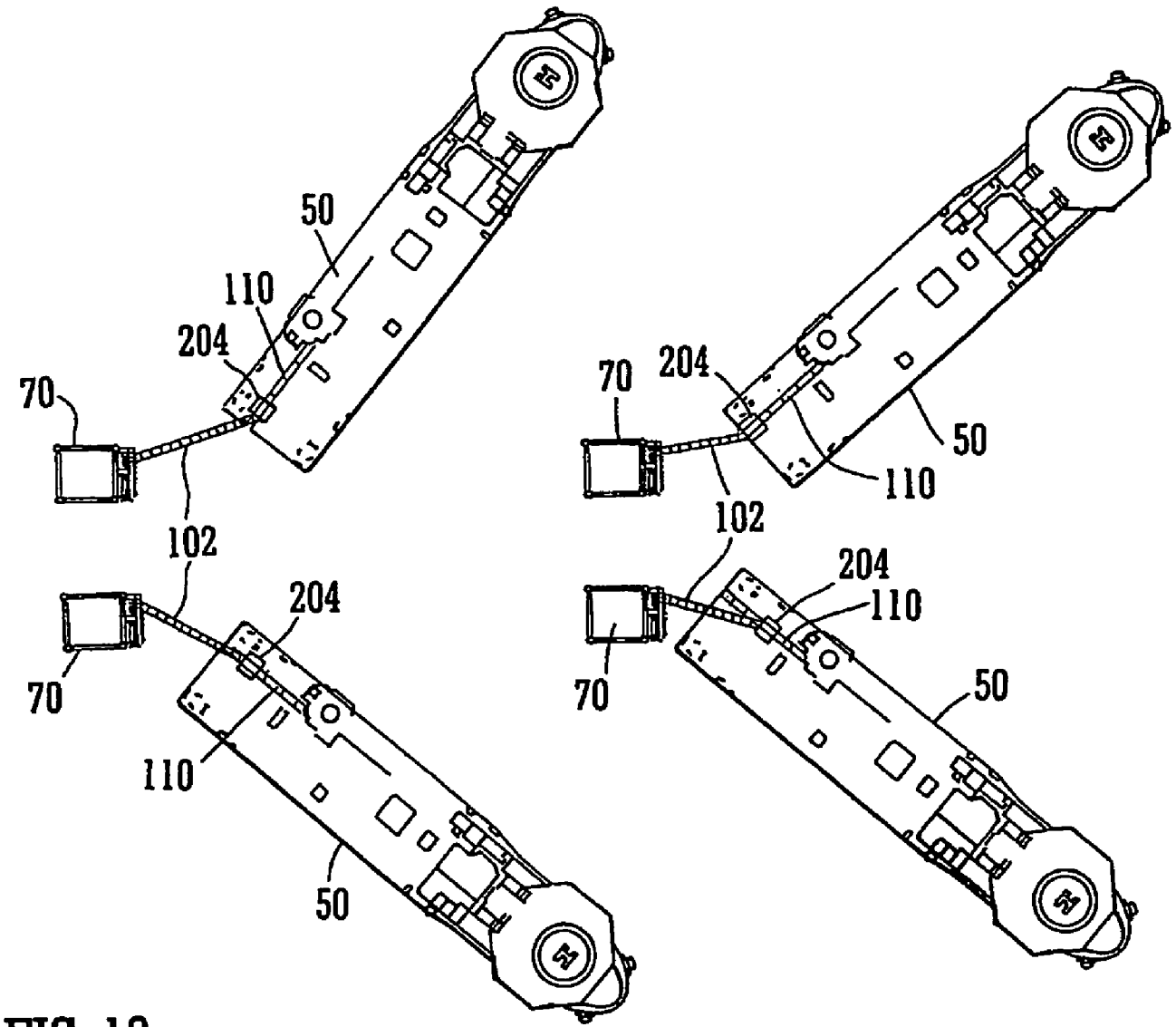
Figure 11:
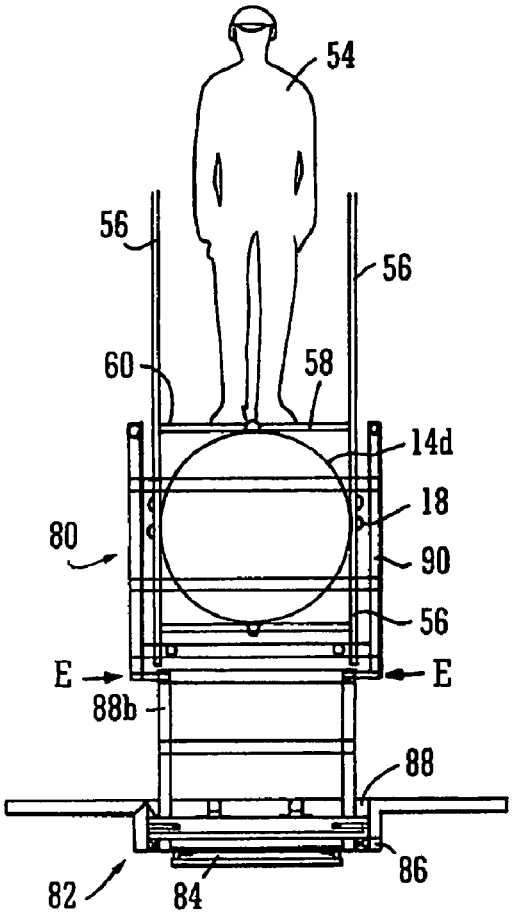
Figure 13:
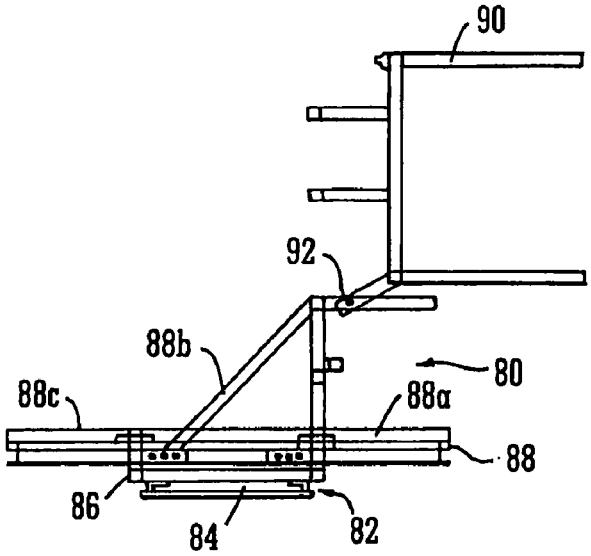
Figure 12:
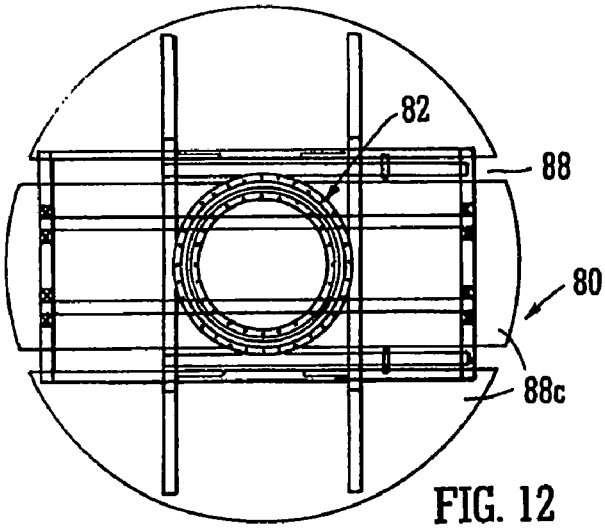
Figure 14:
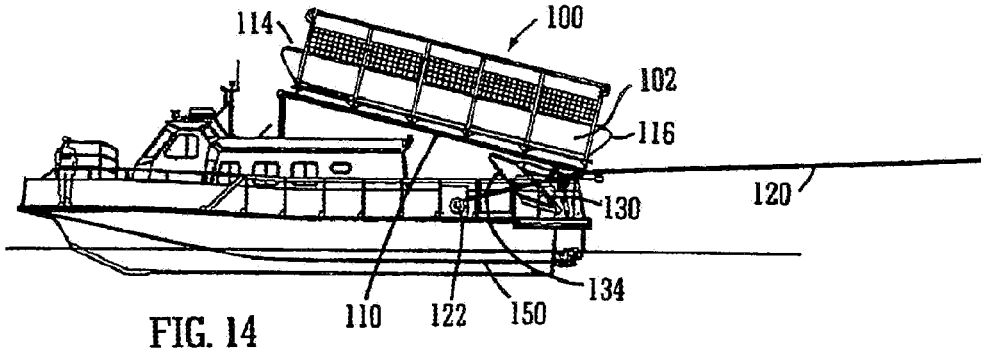
Figure 15:
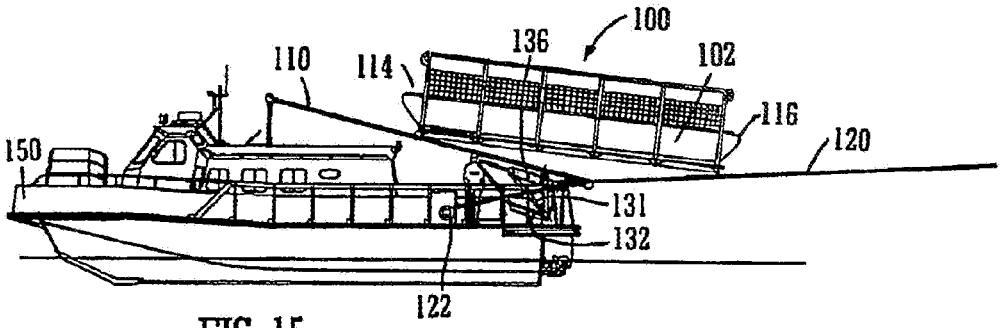
Figure 16:
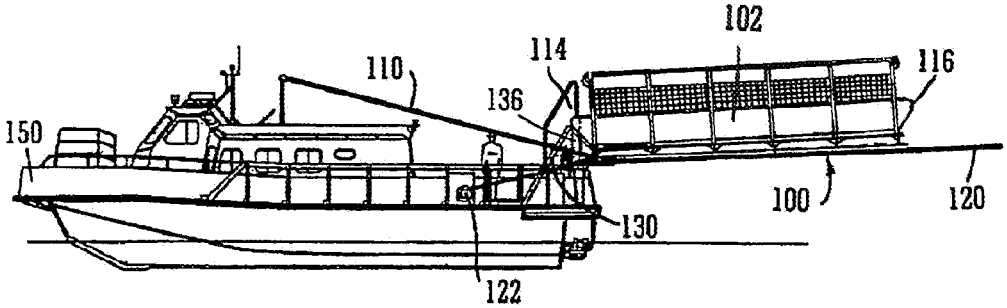
Figure 17:
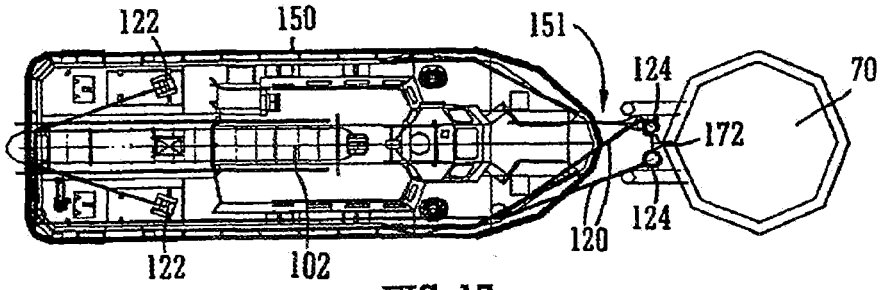
Figure 18:
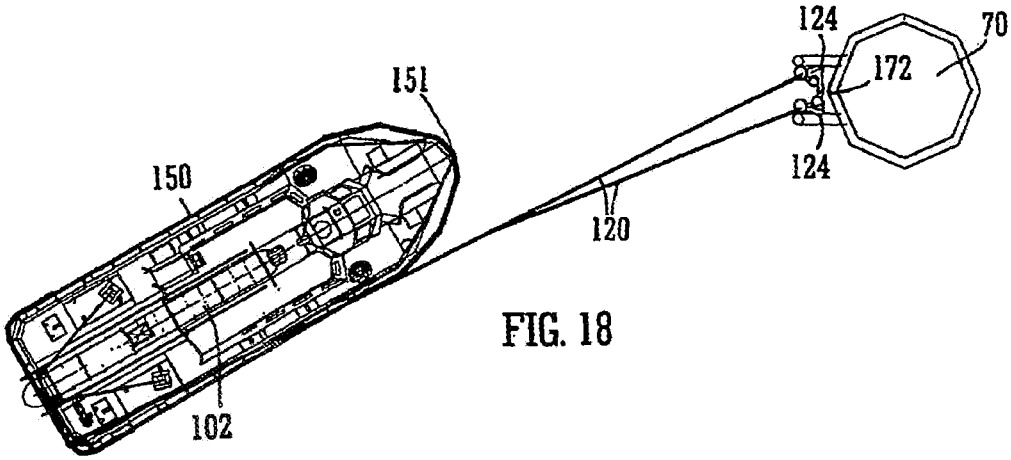
Figure 19:
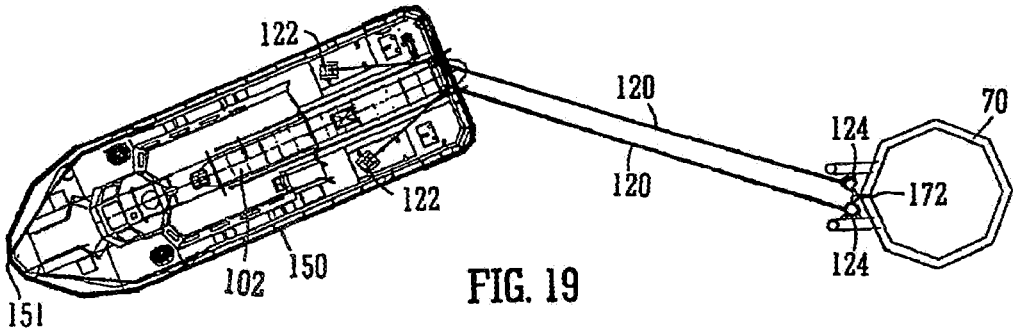
Figure 20:
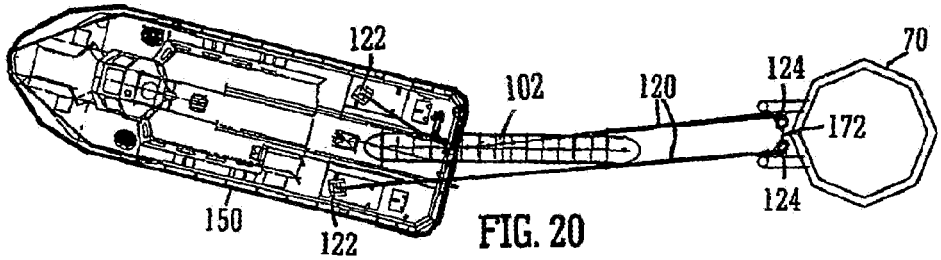
Figure 21:
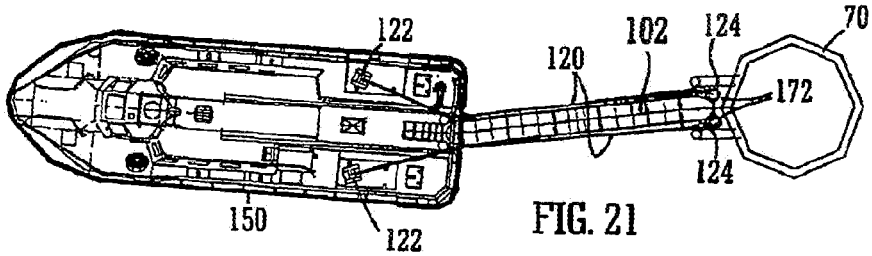
Figure 22:
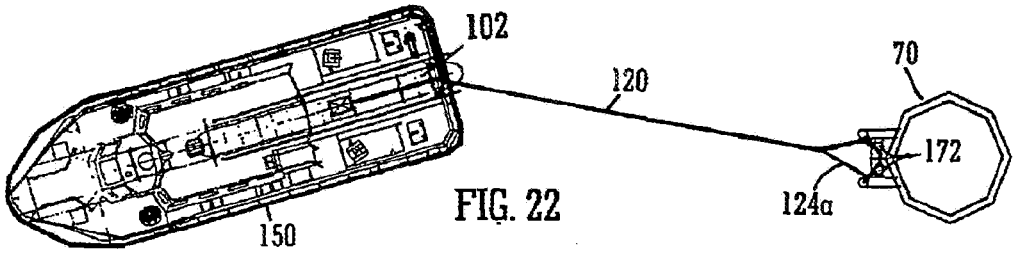
Figure 23:
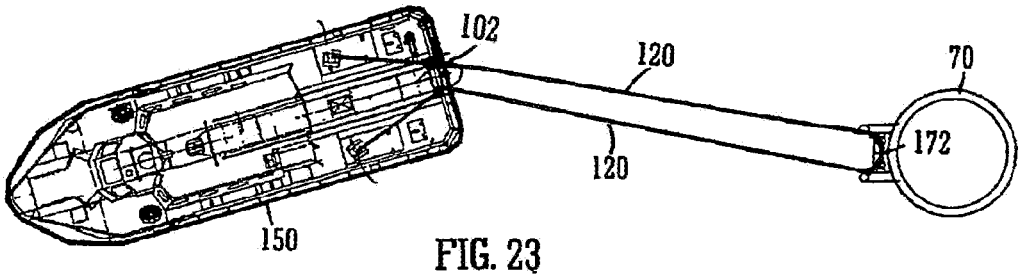
Figure 24:
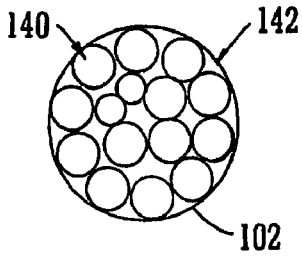
Figure 25:
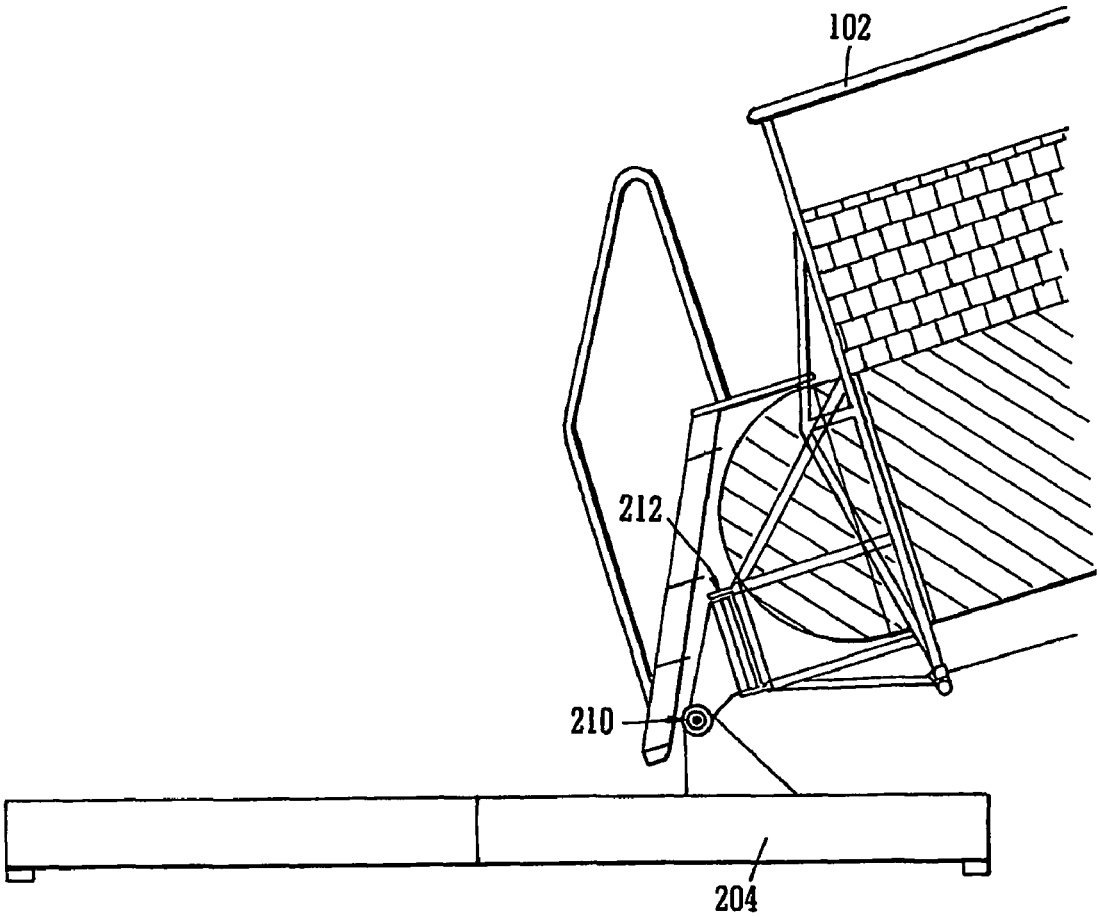

FIGS. 5*a* and 5*b* are respectively side and plan views showing a vessel picking up a guide wire moored to a buoy, adjacent a fixed offshore structure;

FIGS. 6*a* and 6*b* are respectively plan and side views, showing the guide wire attached to the fixed structure and the vessel;

FIGS. 7*a* and 7*b* are respectively plan and side views, showing the first stage of the deployment of the gangway apparatus;

FIGS. 8*a* and 8*b*, are respectively plan and side views of the apparatus of the invention with the gangway apparatus deployed to span the gap between the vessel and the fixed structure;

FIGS. 9*a* and 9*b* show respectively plan and side views of the adjustment of the position of the vessel with respect to the fixed structure;

FIG. 10 shows in a schematic plan view various possible headings and locations of the vessel with respect to the fixed structure;

FIG. 11 is a schematic end view of a mounting means according to the invention when attached to an apparatus of the invention;

FIG. 12 is a schematic plan view of the apparatus of FIG. 11;

FIG. 13 is a side view of the apparatus of FIG. 11;

FIG. 14 is a diagrammatic side view of an apparatus according to another variation of the invention when mounted on a vessel;

FIG. 15 is a diagrammatic side view of the apparatus of FIG. 14 when partially deployed;

FIG. 16 is a diagrammatic side view of the apparatus of FIG. 14 when fully deployed;

FIGS. 17, 18 and 19 are diagrammatic plan views showing stages in alternative methods of attachment of guide wires from a vessel to a fixed structure, in accordance with the invention;

FIG. 20 is a diagrammatic plan view of a vessel and an apparatus of FIG. 14, in a partially deployed state;

FIG. 21 is a diagrammatic plan view of a vessel and an apparatus of FIG. 14 in a fully deployed state;

FIG. 22 is a diagrammatic plan view showing an alternative arrangement of a guide wire extending between a vessel and a fixed structure;

FIG. 23 is a diagrammatic plan view showing a further alternative arrangement of a guide wire extending between a vessel and a fixed structure;

FIG. 24 is a schematic cross section through a an inflatable member of a gangway apparatus according to the invention, comprising a plurality of inflatable tubes; and FIG. 25 illustrates one embodiment of a mounting for the gangway apparatus of the invention.

Referring now in general to FIGS. 3 to 9, there is shown an apparatus 10 according to one embodiment of the invention which provides a bridge, including a gangway apparatus 102, for personnel to transfer on foot from a vessel 50 to a fixed structure 70 (typically an offshore structure) and vice versa. The resulting bridge is also suitable for the transfer of goods and equipment between the vessel 50 and the fixed structure 70. Typically, the fixed offshore structure 70 is a part of a wind turbine or an offshore oil or gas rig, but the fixed offshore structure could equally be a larger vessel (in relation to the vessel 50), a coastal structure such as a sea wall, breakwater or jetty, or a vessel of similar size to the vessel 50. Although not specifically illustrated, the apparatus can be used to effect transfer of personnel and/or equipment between larger vessels typically of generally similar size such as cargo vessels or supply vessels. For use between two larger vessels, the apparatus 10 typically has broadly the same construction as apparatus 10 for use between a vessel 50 and a fixed structure 70, but may be on a larger scale to provide a higher carrying capacity. A typical carrying capacity for transfer of equipment between vessels is about 6 tonnes and a typical span is from about 20 to 40 m.

The apparatus 10 according to the invention comprises, in general terms, a gangway apparatus 102, a runway 110, at least one guide wire 12, 120, a first winch and associated cable for moving the gangway apparatus 102 up and down the runway 110 on deployment and recovery respectively, and a constant tension winch for maintaining a desired tension in the guide wire 12, 120.

When installed between the vessel 50 and the fixed offshore structure 70, the gangway apparatus part 102 of the apparatus 10 provides a means by which personnel such as commissioning or maintenance personnel for a wind turbine can step between the vessel 50 and the fixed structure 70 with greater safety and in a wider range of sea conditions and also a means by which maintenance or repair equipment can be transferred from the vessel 50 to the fixed structure 70. At its point of attachment to the fixed structure 70, the relative motion of the gangway apparatus 102 with respect to the fixed structure 70 is slight, or even negligible, and similarly the relative motion between the gangway apparatus 102 and the vessel 50 at the point where the gangway apparatus 102 meets the vessel is minimised, despite the fact that the vessel may be pitching, rolling or moving back and forth by action of the waves on the vessel 50. Thus the health and safety risks associated with stepping from a vessel 50, moving unpredictably because of wave motion, to the fixed structure 70 are much reduced or eliminated.

The apparatus 10 uses one or more tensioned ropes 12, 120 extending between the vessel 50 and the fixed structure 70 by which the gangway apparatus 102 is supported. The gangway apparatus 102 most preferably comprises one or more inflatable members. When the inflatable members 14 are inflated, the gangway apparatus 102 can extend from the vessel 50 to the fixed structure 70 and provide a safe "bridge" for the transfer of personnel. Also, the vessel 50 is allowed considerable freedom of movement in maintaining its station with respect to the fixed structure 70, which allows the vessel operator to adjust the position and/or heading of the vessel to accommodate prevailing weather conditions. Further, in the unlikely event that the apparatus 10 should fail, and the gangway apparatus 102 falls into the water and, because of the inflatable member(s) 14, the gangway apparatus 102 floats, so providing a safe refuge for personnel until rescue can be effected.

In use of the apparatus for transfer between a vessel 50 and a fixed structure, the apparatus 10 may initially be provided in its compact (non-inflated) state on the vessel 50. The vessel 50 is brought a location proximate the fixed structure 70 and at least one guide wire is connected between the vessel 50 and the fixed structure 70 at a suitable location 74 of entry onto the structure, such as a ladder or platform 72 on the fixed structure 70. The location 70 is most preferably at a point which is above the maximum wave height in the prevailing conditions. On the vessel 50 the wire 12 is attached to means for maintaining a substantially constant tension in the wire 12. Suitable means include one or more winches (not shown in FIGS. 3 to 10) fitted with constant tension devices. Such winches are known in the art.

When connection by means of guide wire 12 between the vessel 50 and the fixed structure 70 has been established, the vessel may adjust its location to a chosen position relative to the fixed structure 70. In the chosen location, the vessel 70 thrusts away from the fixed structure 70 but is restrained from moving away by the wire 12 and the action of the constant tension winch. Thus the desired tension is maintained in the wire 12.

The gangway apparatus 102 comprises a plurality of slidable fixings 18 through which a guide wire 12 passes. The slidable fixings 18 connect the gangway apparatus 102 to the guide wire(s) 12, whereby the gangway apparatus 102 may be supported by the wire(s) 12. The slidable fixings 18 may conveniently include rings through which a guide wire 12 passes. To establish the walkway between the vessel 50 and the fixed structure 70, or between respective vessels, the (or each) inflatable member 14 of the gangway apparatus 102 is inflated with a suitable inflation fluid which is most conveniently air. The air may be pumped into the inflatable member 14, or may be supplied form an air storage source such as compressed air cylinders. Inflation of the inflatable member 14 may be effected each time the inflatable member 14 is used but more preferably the inflatable member 14 is inflated once and maintained in its inflated condition throughout the use of the gangway apparatus 102 at a number of different locations.

The inflatable member 14 takes the form of one or more longitudinally extensive tubes which, when extended, span the gap between the vessel 50 and the fixed structure 70 or between respective vessels. The tubes are preferably independently inflatable, so that any inflation failure of one tube does not cause failure of others of the inflatable tubes 14 or of the whole gangway apparatus 102. Thus, in its inflated and deployed state, the gangway apparatus 102 of the invention extends from the vessel to the point of entry 74 to the fixed structure 70 or to the second vessel.

Preferably the apparatus 10 of the invention is constructed to allow the gangway apparatus 102 to be maintained in its inflated state for all or part of its working or operational period, that is, in addition to the specific time when the apparatus is disposed between a vessel 50 and a fixed structure 70. For example, a work site where the apparatus 100 of this embodiment of the invention is deployed may include a number of fixed structures 70, such as wind turbines, to or from which personnel and equipment are transferred at various times during the operational period. Likewise, transfer may be required on one occasion to a fixed structure 70 and on a subsequent occasion to a second vessel. In this case it is inconvenient to deflate and re-inflate the inflatable member 14 the gangway apparatus 102 each time it is moved between one fixed structure 70 or vessel and another. Accordingly, the invention allows the gangway apparatus 102 to be maintained in its inflated state at least for movement of the apparatus 100 from one fixed structure 70 to another fixed structure 70. For longer movements, e.g. journeys to the work site from the vessel's home port, the gangway apparatus 102 may or may not be in its deflated state. This construction of the invention is also applicable to apparatus of fixed construction, that is, apparatus which in which the gangway apparatus 102 is not inflatable/deflatable or otherwise changeable between expanded and compact states. For example, the gangway apparatus may be filled with a foam material which provides required rigidity and is also buoyant.

Thus, the vessel 50 is provided with at least one runway or slider 110 on which one part, preferably an end portion, of the gangway apparatus 102 is mounted. The runway 110 is preferably a rigid rail or, more preferably, a pair of rails, on which the gangway apparatus 102 is mounted. The gangway apparatus 102 is mounted on the runway 110 such that, in use, it is free to move along the length of the runway 110. The rails are preferably rectilinear, but may, if appropriate, be curved. In other constructions, the runway may be, for example, one or more tensioned wires or cables. In the drawings, a pair of rails 111, 112 is shown.

Rails 111, 112 are fixedly mounted on the vessel 50. In the illustrated example, the rails 111, 112 extend in parallel from a highest point towards the central region of the vessel 50 to a lowest point near the stem of the vessel 50. In alternative constructions, the rails 111, 112 may extend from a highest point towards a central region the vessel 50 to a lowest point near the side of the vessel 50. As can be seen in particular in FIGS. 5 and 14, the gangway apparatus 102 is carried during movement of the vessel between fixed structures 70 (and during any other movements, as required) on the rails 111, 112 so that one end 114 of the apparatus 102 is towards the upper end 114 of the rails 111, 112 and one end 116 of the apparatus 102 is towards the lower end of the rails 111, 112. The end 114 of the gangway apparatus 102 is preferably permanently attached to the rails 111, 112 and most preferably remains so attached when the bridge member is deployed, that is, in its condition of use (FIGS. 8, 9 and 16).

However, a releasable attachment is not precluded. The end 114 is attached by suitable means (not specifically shown) such as wheels, casters, low friction pads or the like, which allow the end 114 to slide up and down the rails 111, 112 when required to do so. Most preferably, the end 114 is attached to a skate, truck, bogie, carriage or the like 204. The skate 204 is arranged to traverse the rails 111, 112 as will be discussed in more detail below The end 116 may be (but need not be) releasably secured to the rails 111, 112.

The method of deployment and use of the apparatus 10 of the invention will now be described in more detail with reference to the FIGS. 5 to 9. Referring initially to FIGS. 5*a* and 5*b*, the gangway apparatus 102 is mounted on a runway 110. This represents a stored condition of the gangway apparatus 102, in particular for movement between different worksites. A cable (not shown) is attached to the gangway apparatus 102 preferably at its upper end (when on the runway), and the other end of the cable is attached to a first winch. At this stage, the gangway apparatus 102 is preferably fixedly retained on the runway by suitable locking or braking means intended to secure the gangway apparatus 102 in position during transit. When the gangway apparatus 102 is required for use, the first winch is used to take slack out of the cable and the locking means are released. The gangway apparatus 102 is thereby retained in its position on the runway 110 by the cable and the first winch.

In a preferred arrangement a cable 200 extends from the fixed structure 70 to a moored buoy 202. The buoy 202 is retained by mooring cable 205, which is, in turn, typically attached by suitable means to the seabed. The vessel 50 approaches the buoy stern first and the cable 200 is retrieved, the cable 200 then providing at least a part of the guide wire 12 for the gangway apparatus 102. In alternative arrangements the cable may paid out directly from the fixed structure to the vessel 50, or vice versa.

The guide wire 12 is fed through guides (slidable fixings 18) on the gangway apparatus 102, and then attached to a constant tension winch on the vessel 50. The constant tension winch is used to take up the tension in the guide wire 12, while the vessel 50 thrusts gently ahead (that is, away from the fixed structure 70). In this way, the gangway apparatus 102, which is mounted on a skate 204, is caused to slide down the rails 111, 112 of runway 110 so that it extends beyond the stern of the vessel 50. To allow this movement of the gangway apparatus 102, wire is paid out from the first winch (FIGS. 6 and 7).

At this stage, the gangway apparatus 102 is preferably fully extended from the vessel 50 and is supported on the guide wire 12, which extends between the vessel 50 and the fixed structure 70. The forward thrust of the vessel 50 is then reduced, and by the action of the constant tension winch, the vessel 50 is pulled towards the fixed structure 70 until the leading end 116 of the gangway apparatus 102 meets the location of entry 74 of the fixed structure 70 (FIG. 8). The gangway apparatus 102 may be secured at its leading end 116 to the fixed structure 70 by suitable means but this may be neither essential nor desirable, for reasons outlined below.

Preferably the vessel 50 then moves further aft (towards the fixed structure 70) (FIG. 9), with the tension in the guide wire 12 being taken up by the constant tension winch. As the vessel 50 moves aft, the skate 204 thus moves along runway 110 and most preferably the afterward movement of the vessel 50 is continued until the skate 204 reaches a mid position with respect to the length of the runway 110. The gangway apparatus 102 is then ready for the transfer of personnel, goods or equipment. Preferably a walkway 206 is provided parallel to the runway 110 to facilitate the transfer of personnel, goods or equipment from the vessel 50 onto the gangway apparatus 102.

While in use, the gangway apparatus 102 is free to move with respect to the vessel 50. Specifically, as the vessel 50 moves fore and aft of the skate 204 makes a corresponding movement up and down the runway 110 (FIG. 10).

It is greatly preferred that at all times, the vessel 50 is free to move, and no attempt is made to make a "fixed mooring" of the vessel 50 to the fixed structure 70. The maximum forces imposed on the gangway apparatus 102 and fixed structure 70 due to the constant tension winch and typically amount to about 3 tonnes. If for some reason, this fails the guide wire 12 may break, typically at a force of about 15 tonnes. If this happens, the gangway apparatus 102 is still attached to the vessel 50 by means of the cable connected to the first winch. Anyone who is on the gangway apparatus 102 in the event of such an unfortunate occurrence is still able to return to the vessel 50 by walking up the gangway apparatus 102 and/or by using the first winch to pull the gangway apparatus 102 back up the runway 110.

Also, if the vessel 50 moves off station so that the skate 204 reaches the end of its travel at the low end of the runway 110, the constant tension winch is able to pay out cable (guide wire 12). This allows the gangway apparatus 102 to move away from the fixed structure 70 (as the vessel 50 moves away) and so, of course, a gap is opened between the end of the gangway apparatus 102 and the fixed structure 70, and passage from the gangway apparatus 102 to the fixed structure 70 is prevented. Nevertheless, personnel on the gangway apparatus 102 at the time can still safely return to the vessel 50 until the vessel 50 regains its station.

If the vessel 50 is unable to regain its station and continues to move away from the fixed structure 70, the constant tension winch pays out all of the guide wire 12. This allows the leading end 116 of the gangway apparatus 102 to fall into the water, where, being buoyant, it floats. Personnel may return to the vessel 50 by climbing up the gangway apparatus 102 and the gangway apparatus 102 may be returned to the vessel by action of the first winch.

After use of the gangway apparatus 102, the tension in the guide wire 12 is released and the gangway apparatus 102 is pulled back onto the runway 110 using the first winch and attached cable. The gangway apparatus 102 is then secured to the runway 110. The guide wire 12 is then released from the constant tension winch and re-secured to the buoy 202 for future use.

The skate 204, and the runway 110 provide means to accommodate fore and aft movement of the vessel 50. As illustrated in FIG. 25, a mounting arrangement 208 is also provided between the gangway apparatus 102 and the skate 204 (the skate being shown only schematically) to accommodate lateral movements of the vessel with respect to the fixed structure, such as changes in the heading of the vessel and movement of the vessel 50 due to wind, tides, currents etc. The mounting arrangement 208 includes a first coupling 210 which accommodates relative movement between the skate and the gangway apparatus about a nominally horizontal axis and a second coupling 212 which accommodates relative movement about an upright axis, the orientation of which tends towards, or may be, vertical. The inflatable nature of the gangway apparatus 102 provides it with a degree of flexibility so that it can accommodate torsional loadings, at least to some extent. The mounting means provided between the gangway apparatus 102 and the skate 204 restrict the torsional movement of the gangway apparatus 102, with respect to the vessel 50. This is important for the stability of the gangway apparatus 102 during transfer of personnel, goods and equipment.

In a preferred arrangement, one or more safety ropes may be provided substantially co-extensive with the gangway apparatus 102 to which safety harnesses worn by personnel may be attached during transfer across the apparatus 10.

In using the apparatus 10, personnel step onto a surface of the gangway apparatus 102 defined (or supported) by one or more inflatable member (s) 14. This transition is made from a safe area well within the deck area 52 of the first vessel 50, and typically from walkway 206, so that in the event of any slip or trip at this stage the person 54 remains on the deck 52. Personnel then move along the gangway apparatus 102 by walking along the surface thereof until they reach the entry location 74 of the fixed structure or second vessel where they can safely step onto the access ladder 72, platform or deck before unclipping their safety harness. The step onto the entry location 74 is easy in the absence of any significant relative motion between the gangway apparatus 102 and the fixed structure 70 or second vessel (as appropriate).

Figure 1:
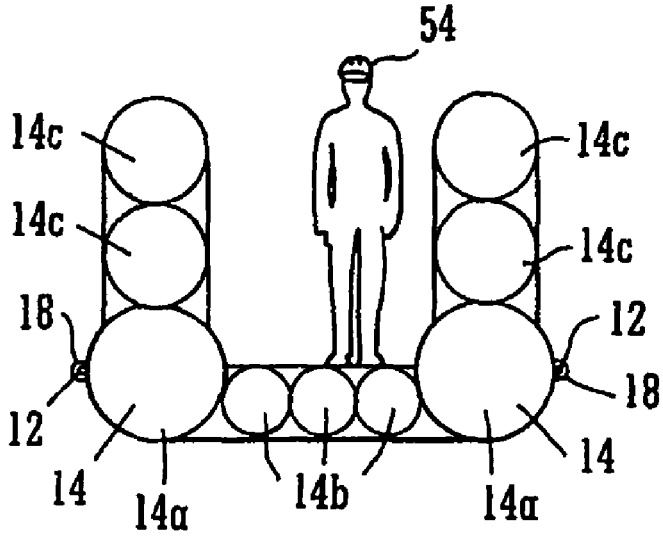
FIGS. 1 and 2 are schematic cross sections through embodiments of the gangway apparatus of the invention.
Figure 2:
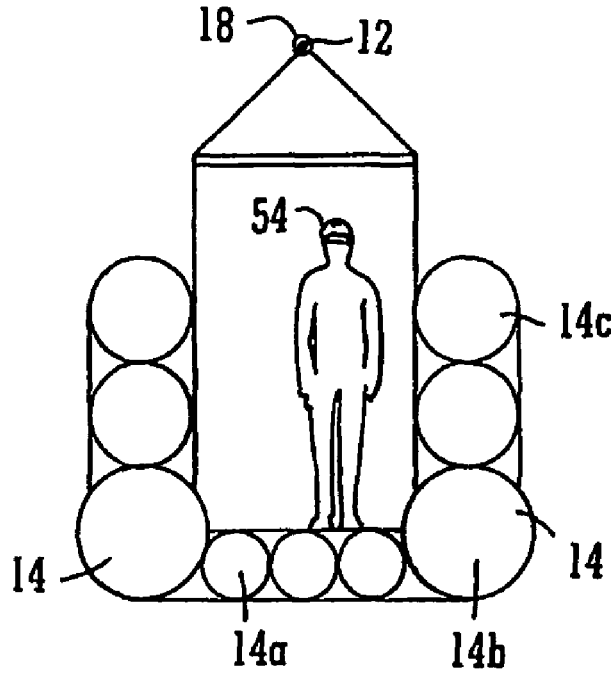
Figure 3:
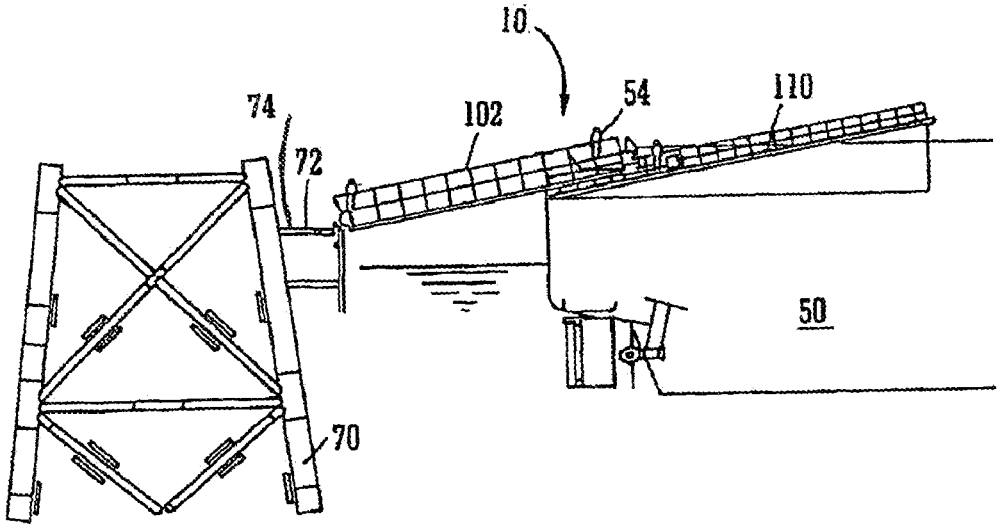
FIGS. 3 and 4 are respectively side and plan views of the apparatus of the invention in use for transfer of personnel to a fixed offshore structure.
Figure 4:
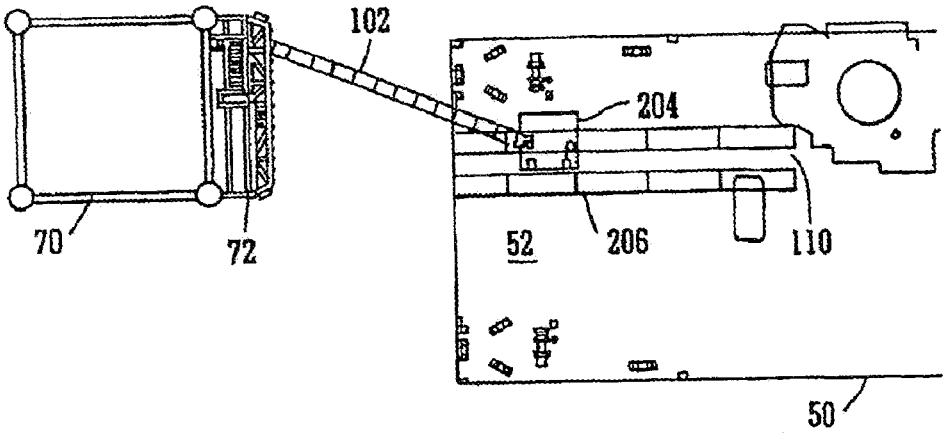

Referring in particular to FIGS. 1 and 2 it can be seen that gangway apparatus 102 of the invention may comprise a plurality of inflatable members 14*a*, 14*b* and 14*c*. In the embodiment of FIG. 1, principal inflatable members 14*a* are attached to the slidable fixings 18 which in turn are supported on a pair of guide wires 12. Inflatable members 14*b* define the surface on which personnel 54 may walk across the gangway apparatus 102 and inflatable members 14*c* define side walls which assist in preventing personnel 54 from falling from the structure.

The construction of the embodiment in FIG. 2 is similar, except that the inflatable members are suspended via slidable fixings 18 from a single guide wire 12. In each of the embodiments of FIGS. 1 and 2 the individual inflatable members 14 may be joined one to another, but each is most preferably independently inflatable.

In a more preferred alternative form of the gangway apparatus 102 (shown in FIG. 24), the gangway apparatus 102 comprises a plurality of parallel inflatable tubes 140 enclosed in an outer skin 142. The inflatable tubes 140 are arranged within the outer skin 142, such that the outer skin 142 is substantially cylindrical. The inflatable tubes 142 need not all be of the same diameter. Typically, the outer skin may contain about 10 to 20, preferably about 15, inflatable tubes 140, each having a nominal diameter of about 250 to 300 mm, preferably about 280 mm. The diameter of the outer skin 142 when the tubes 140 are inflated is then about 0.8 to 1.2 m, preferably about 1 m. If one or two of the inflatable tubes 142 are punctured the remaining tubes 142 can expand to fill the space so created. Although the pressure in the remaining intact inflatable tubes 142 falls slightly, the gangway apparatus 102 remains sufficiently rigid for it to be crossed in safety.

Although the apparatus 10 of the invention has been principally described above as employing a plurality of inflatable members 14, in alternative but are less preferred embodiment a single in inflatable member 14 may be used.

Where one or more inflatable members is/are provided, an upper part of one or more of the inflatable members provides a surface on which personnel 54 may traverse the gangway apparatus 102. Similarly, where a plurality of inflatable members are provided surrounded by an outer skin an upper part of the inflatable skin provides a surface on which personnel 54 may traverse the gangway apparatus 102. In preferred arrangements, this upper surface may be provided with a non-slip surface, such as a non-slip layer or coating. In alternative arrangements, a surface 58 on which personnel 54 walk may be supported by an upper surface of one or more of inflatable members.

Where a single inflatable member or a plurality of inflatable members enclosed in an outer skin is provided, a plurality of upright posts 56 attached at intervals to gangway apparatus 102 is preferably provided and ropes or nets 57 are attached to said posts 56. The upright posts 56 may, for example, be attached in fixed relation to some of the slidable fixings 18, for example to every third fixing 18. In this way, when the gangway apparatus 102 is in its compacted state, the upright posts 56 lie in close proximity to one another and become spaced apart as the inflatable member(s) achieves its (their) expanded state. Alternatively, the upright posts 56 may be separately attachable to the gangway apparatus 102 after its expanded state has been reached. Ropes or nets 57 extending between the upright posts 56 assist in preventing personnel 54 from falling from the gangway apparatus 102 when traversing it, and a safety rope may be provided, attached for example to first and last upright posts 56, to which a safety harness be clipped. Cross members 60 may be provided which extend laterally between respective pairs of upright posts 56 for assisting in retaining the upright posts 56 in their desired position.

FIGS. 14 to 16, illustrate an alternative version of the apparatus 100 of the invention mounted on a relatively small boat 150. Again, the gangway apparatus 102 is mounted on a runway 110, which slopes from a high point towards the centre of the vessel 150 to a low point at the stem. As with apparatus 10 illustrated in FIGS. 3 to 10, one or more guide wires 120 may be retrieved from a moored buoy and subsequently connected to the constant tension winch 122. Alternatively, in this embodiment (and also for the apparatus 10), the guide wire 120 (12), may be entirely mounted on the vessel 150 (50) and paid out from the vessel for attachment to the fixed structure 70 or mounted on the fixed structure and paid out therefrom for attachment to the vessel.

In the embodiment illustrated in FIGS. 14 to 16, the vessel 150 may be provided with a foldable or collapsible ladder 130 which is stowed below the line of rails 111, 112 when not required for use, so as not to interfere with the deployment of the gangway apparatus 102. In the illustrated example, the ladder 130 is in two parts 131, 132 which are pivoted with respect to one another and are connected by a linkage 134. Linkage 134 is connected to a pivoting post 136 which pivots about an axis at 138 to move the ladder 130 from its stowed to its deployed position.

FIGS. 11 to 13 illustrate in particular mounting means 80 for use with certain embodiments of the apparatus of the present invention (in particular the apparatus of FIGS. 14 to 16) which provides compliant freedom for the vessel 50 with respect to the gangway apparatus 102, so that the vessel 50 can surge, traverse back and forth, pitch and roll with respect to the gangway apparatus 102, in response to wave movement to which the vessel 50 is subject, without adversely affecting the gangway apparatus 102, its mountings or the fixed structure 70 and, more especially in the case of smaller vessels 50 such as RIBs, without allowing the gangway apparatus 102 to adversely affect the vessel 50. Similarly, the mounting means 80 assists in accommodating relative movement between first and second vessels when the apparatus of the invention is used for transfer between vessels. Referring in particular to FIGS. 11 to 13 the mounting means 80 comprises a first mounting element 82 which provides the vessel 50 and the gangway apparatus 102 with rotational freedom with respect to one another. The first mounting element 82 comprises a first mounting component 84 which is fixedly attached with respect to the deck of the vessel 50 or with respect to the runway 110 and a second mounting component 86, attached to the first mounting component and which also is (indirectly) attached to the gangway apparatus 102. The mounting components 84, 86 have rotational freedom with respect to each other. A preferred form of the first mounting element 82 is a slew ring bearing. Thus, by means of the first mounting element 82, after the gangway apparatus 102 of the invention has been attached to the fixed structure 70, the vessel 50 is free to adopt a suitable heading, during the transfer of personnel 54, or goods or equipment, to favour the weather or sea conditions. The heading is typically determined by weather, waves, currents or obstructions the transfer site.

The arrangement in relation to use of the apparatus of the invention for transfer between vessels is similar. The first and second mounting components 84, 86 accommodate differences in the course or heading of the vessels and also accommodate relative forward and back motion between the vessels.

Attached to the second mounting component 86 is a first frame element 88. The first frame element includes first and second parts 88*a*, 88*b* which are slidably mounted with respect to one another. Specifically, part 88*a* is mounted in fixed relation to second mounting component 86 and part 88*b* is free to execute translational movement with respect to part 88*a*. The translation freedom of the part 88*b* with respect to part 88*a* accommodates some back and forth movement of the vessel 50 with respect to the gangway apparatus 102. Similarly, for transfer between two vessels using the apparatus of the invention, the second mounting component 86 and frame element 88 accommodate some relative motion of the vessels towards and away from one another. The provision of the runway 110 may obviate the need for the first frame element 88.

In a preferred embodiment, a bias is applied to the second frame element part 88*b*, most preferably to urge the part 88*b* towards the mid point of its permitted translational motion. Suitable biasing means include elastic cord (e.g. shock cord) or rate controlled damping systems. One important objective of the biasing means is to provide a method of force limitation to assist in preventing excessive force being applied to the vessel. The bias forces applied to the part 88*b* may be symmetrical or asymmetrical with regard to the two opposed direction of permitted movement of the part 88*b*.

Locking means may be provided to independently lock the first mounting element 82 to prevent rotational movement and/or to lock the part 88*b* with respect to part 88*a* to prevent translational movement, as may be desirable for transport storage or stowage of the gangway apparatus 102.

An upper part of the component 88*a* may preferably define a surface 88*c* on which personnel may stand before stepping onto the gangway apparatus 102. Although the surface 88*c* may itself be subject to translational and or rotational movement, there is little, if any, movement with respect to the gangway apparatus 102. Thus stepping from the deck 52 onto the surface 88*c* is simple, as is stepping from the surface 88*c* onto the gangway apparatus 102.

A second frame element 90 is attached to the end of the gangway apparatus 102 to support the gangway apparatus 102 in use. The second frame element 90 is also pivotally connected at 92 to the first frame element part 88*b*, so that the second frame element 90 and the first frame element part 88*b* pivot with respect to one another about an axis E-E which is nominally horizontal and which is substantially perpendicular in use to the longitudinal axis of the gangway apparatus 102 and inflatable member(s) 14. "Nominally horizontal" is used in the sense that the pivot axis would be substantially horizontal when the vessel 50 (or first vessel) is on a flat calm sea. Of course, in more usual sea conditions, some variation from the true horizontal is inevitable. The pivotal connection 92 accommodates pitch and roll of the vessel 50 caused by wave motion. Similarly, when the apparatus of the invention is used for transfer between two vessels the pivotal connection 92 accommodates relative upward and downward movement of the respective vessels and rolling motion of the first vessel.

Further, the pivotal connection 92 may allow the gangway apparatus 102, in its compact state, to be retained in a safe stowage position. When required for use, the gangway apparatus 102, supported in second frame element 90 may be pivoted about axis E-E to its use position, prior to inflation of the inflatable member(s) 14.

The attachment between the end of the gangway apparatus 102 and the second frame element 90 may desirably be designed to fail in the event of excessive force, thereby to allow the vessel to move away from the gangway apparatus 102 (or the first and second vessels to move apart), for example in severe weather conditions.

Although the mounting means 80 has been primarily described in relation to a gangway apparatus 102 comprising a single inflatable member 14*d*, the mounting means are also suitable for use with gangway apparatus 102 including a plurality of inflatable members 14.

FIGS. 17, 18 and 19 illustrate one alternative (and currently less preferred) method by which guide wires 120 are attached to fixed structure 70. In FIG. 17, the vessel 50 is shown approaching the fixed structure 70, with its bow 151 leading. When the vessel 50 is proximate the fixed structure 70, guide wires 120 are attached to suitable attachment points on the fixed structure 70. As indicated above, the attachment points are so located that when the gangway as 102 is deployed, personnel may transfer safely from the gangway apparatus 102 onto the fixed structure 70. Thus, in particular, the attachment points will normally be so located that the leading end 116 of the deployed gangway apparatus 102 is above the maximum wave height. In the example of FIGS. 17 to 19, two guide wires 120 extend in parallel from the vessel 50 to the fixed structure 70. Each guide wire 120 includes a loop 124 at its end which is simply placed over, on or around an appropriate attachment point 172 on the fixed structure 70. The attachment point 172 may, for example include a locking or latching means which secures the loop 124 from becoming unintentionally detached.

As indicated in FIGS. 18 and 19, after the guide wires 120 have been attached to the fixed structure 70, the vessel 50 is turned and maneuvered into its desired alignment and position with respect to the fixed structure 70. The alignment of the vessel will depend on factors such as wind and sea conditions. The apparatus 10, 100 is then deployed as described with respect to FIGS. 14 to 16, 20 and 21.

An alternative arrangement is shown in FIG. 22 in which only one guide wire 120 is used. The guide wire 120 includes a single loop 124*a* at its end which is placed over, on or around one or more suitable attachment means 172.

A further alternative arrangement is shown in FIG. 23 in which a single guide wire 120 is also used. In this case, the guide wire has no loop 124. Rather, the leading end of the guide wire 120 is passed through suitable attachment means 172 on the fixed structure 70 and then returned to the vessel where it is preferably connected to a winch 122.

The apparatus 10 is also suitable for use in transferring personnel and/or equipment between vessels at sea. In this case, the apparatus 10 is mounted on a first of the vessels. The runway 110 (with rails 111, 112) need not be arranged in a fore-and-aft alignment with respect to the first vessel. For example the runway 110 may be in an alignment abeam of the vessel to facilitate transfer between vessels located side by side. The guide wire or wires 12, 120 are secured between the vessels, preferably using one of the arrangements described above (where the second vessel takes the place of fixed structure 70), and the gangway apparatus 102 is caused to slide along the runway 110 and the guide wire(s) 12, 120 thereby to span the gap between the vessels. As noted above, movement of the gangway apparatus 102 is preferably by means of a winch and cable arrangement. Preferably constant tension winches are used to maintain the guide wire or wires 12, 120 at a desired tension. Preferably, the gangway apparatus 102 is inflatable and deflatable to minimise its volume when stowed.

The invention claimed is:

1. A method of providing access between a first marine structure comprising a vessel navigatable under its own power and a second marine structure comprising:

providing the first marine structure with a runway;

providing a gangway apparatus mounted in a stored condition on the runway, the gangway apparatus comprising one or more linkages by means of which the gangway apparatus is mounted on the runway and is moveable along the runway from the stored condition to, or towards, a use condition;

navigating the vessel to a position such that the vessel and the second marine structure are proximate one another;

providing at least one guide wire, the gangway apparatus being attached or attachable to a said guide wire by means of one or more slidable fixings;

connecting the at least one guide wire between a location on the first marine structure and an attachment location on the second marine structure proximate the location of entry to the second marine structure;

with said guide wire connected between the vessel and the second marine structure, controlling and, where necessary, adjusting the position of the vessel with respect to the second marine structure so that the vessel and the second marine structure are maintained in spaced apart relation to one another, and maintaining the at least one guide wire at a tension sufficient to support said gangway apparatus;

moving the gangway apparatus from the stored condition to the use condition by moving the gangway apparatus such that said linkage moves along the runway and sliding the slidable fixing(s) along a said guide wire and, where necessary, adjusting the position of the first marine structure until the gangway apparatus spans the gap between the first marine structure and location of entry to the second marine structure, and;

allowing the linkage freely to traverse the runway to accommodate relative movement of the vessel and the second marine structure towards and away from each other.

2. A method as claimed in claim 1 wherein the runway is inclined with respect to the horizontal such that the gangway apparatus moves downwardly when moving from the stored condition to the use condition.

3. A method as claimed in claim 1 wherein at least one end portion of the gangway apparatus remains connected to the runway when the gangway apparatus is in its use condition.

4. A method as claimed in claim 1 wherein the second marine structure is a vessel.

5. A method as claimed in claim 1 wherein the gangway apparatus comprises at least one inflatable member attached to a said guide wire by said slidable fixings and transformable by inflation thereof from a compact state to an extended state, the method further comprising inflating the inflatable member with an inflating fluid before said gangway apparatus is moved along said runway.

6. A method as claimed in claim 1 wherein the gangway apparatus comprises at least one inflatable member attached to a said guide wire by said slidable fixings and transformable by inflation thereof from a compact state to an extended state, the method further comprising inflating the inflatable member with an inflating fluid after said gangway apparatus is moved along said runway.

7. A method as claimed in claim 1 wherein the gangway apparatus slides along the runway contemporaneously with the step of sliding the gangway apparatus along the guide wire(s).

8. A method as claimed in claim 5 comprising providing a gangway apparatus comprising a single inflatable member.

9. A method as claimed in claim 5 comprising providing a plurality of inflatable members.

10. A method as claimed in claim 9 wherein the inflatable member comprises an outer skin enclosing a plurality of inflatable tubes.

11. Apparatus for providing a bridge structure for the transfer of personnel, goods or equipment from a vessel to a second marine structure, the apparatus comprising:

a gangway apparatus operatively moveable from a stored condition to a use condition;

a runway mounted on the vessel and on which the gangway apparatus is mounted in its stored condition;

at least one guide wire and means for attaching the guide wire to the vessel and to an attachment location on the second marine structure proximate the location of entry to the second marine structure;

means mounted in use on the vessel for maintaining a desired tension in the at least one guide wire;

one or more linkages selected from the group consisting of a skate, truck, bogie and carriage attached to said gangway apparatus by means of which the gangway apparatus is freely movable along the runway from the stored condition to, or towards, the use condition; and one or more slidable fixings attached to the gangway apparatus and slidable along a said guide wire on deployment of the gangway apparatus, by means of which fixings the gangway apparatus is operatively supportable by the at least one guide wire to span the gap between the vessel and the second marine structure.

12. Apparatus as claimed in claim 11 wherein the runway is inclined to horizontal.

13. Apparatus as claimed in claim 11 wherein the runway comprises at least one rigid rail.

14. Apparatus as claimed in claim 13 wherein the runway comprises a pair of substantially parallel rails.

15. Apparatus as claimed in claim 13 wherein the at least one rail is rectilinear.

16. Apparatus as claimed in claim 11 wherein the runway comprises one or more tensioned cables.

17. Apparatus as claimed in claim 12 wherein the runway is mounted in use to extend from a highest point towards a central region of the vessel to a lowest point near the stern or side of the vessel.

18. Apparatus as claimed in claim 11 wherein at least an end portion of the gangway apparatus remains attached to the runway in the use condition.

19. Apparatus as claimed in claim 11 wherein the gangway apparatus comprises at least one inflatable member.

20. Apparatus as claimed in claim 11 wherein the gangway apparatus comprises a plurality of inflatable members which are independently inflatable.

21. Apparatus as claimed in claim 20 wherein the gangway apparatus comprises an outer skin enclosing a plurality of inflatable tubes.

22. Apparatus as claimed in claim 19 wherein at least one inflatable portion of the gangway apparatus, in its expanded state, has an upper surface which operatively forms a walkway for personnel using the bridge structure.

23. Apparatus as claimed in claim 20 further comprising means for joining two or more inflatable members together to form said walkway.

24. Apparatus as claimed in claim 23 wherein said two or more inflatable members are joined in side-by-side relation.

25. Apparatus as claimed in claim 20 further comprising inflatable members defining in their expanded state side walls of the bridge structure.

26. Apparatus as claimed in claim 25 further comprising means for joining two or more inflatable members together to form said side walls.

27. Apparatus as claimed in claim 26 wherein said two or more inflatable members are joined in side-by-side relation.

28. Apparatus as claimed in claim 22 wherein said upper surface includes a non-slip surface.

29. Apparatus as claimed in claim 11 further comprising a plurality of upright posts attached at intervals to said gangway apparatus and safety ropes or nets attached to said posts.

30. Apparatus as claimed in claim 11 further comprising at least one safety rope extending lengthwise of the bridge to which a user's safety harness is operatively attachable.

31. Apparatus as claimed in claim 19 wherein the at least one inflatable member is, in its expanded state, operatively suspended below a single guide wire.

32. Apparatus as claimed in claim 19 wherein the at least one inflatable member is, in its expanded state, operatively mounted above a single guide wire.

33. Apparatus as claimed in claim 19 wherein the at least one inflatable member is, in its expanded state, operatively mounted on a pair of substantially parallel guide wires.

34. Apparatus as claimed in claim 11 wherein the second marine structures is a vessel.

35. A method for transferring of personnel, goods or equipment from a vessel to a second marine structure, the method comprising:

providing a gangway apparatus moveable from a stored condition to a use condition;

providing a runway mounted on the vessel and on which the gangway apparatus is mounted in its stored condition;

providing at least one guide wire and means for attaching the guide wire to the vessel and to an attachment location on the second marine structure proximate the location of entry to the second marine structure;

providing means mounted in use on the vessel for maintaining a tension in the at least one guide wire sufficient to support said gangway apparatus;

providing one or more linkages attached to said gangway apparatus by means of which the gangway apparatus is mounted on, and is freely movable along the runway from the stored condition to, or towards, the use condition; and providing one or more slidable fixings attached to the gangway apparatus and slidable along a said guide wire on deployment of the gangway apparatus, by means of which fixings the gangway apparatus is operatively supportable by the at least one guide wire to span the gap between the vessel and the second marine structure.

36. A vessel comprising:

a gangway apparatus operatively moveable from a stored condition to a use condition;

a runway mounted on the vessel and on which the gangway apparatus is mounted in its stored condition;

at least one guide wire and means for attaching the guide wire to vessel and to an attachment location on the marine structure proximate the location of entry to the marine structure;

means mounted in use on the vessel for maintaining a tension in the at least one guide wire sufficient to support said gangway apparatus;

one or more linkages attached to said gangway apparatus by means of which the gangway apparatus is mounted on, and is freely movable along the runway from the stored condition to, or towards, the use condition; and one or more slidable fixings attached to the gangway apparatus and slidable along a said guide wire on deployment of the gangway apparatus, by means of which fixings the gangway apparatus is operatively supportable by the at least one guide wire to span the gap between the vessel and the marine structure.

37. A vessel as claimed in claim 36 comprising an inflatable boat.

* * * * *